US006367732B1

(12) United States Patent
Bobren et al.

(10) Patent No.: US 6,367,732 B1
(45) Date of Patent: Apr. 9, 2002

(54) STRAPPING MACHINE WITH TWISTED BELT DRIVE

(75) Inventors: Allan J. Bobren, Streamwood; James A. Haberstroh, Vernon Hills; Timothy B. Pearson, Antioch, all of IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/597,339

(22) Filed: Jun. 19, 2000

(51) Int. Cl.[7] ..... B65H 20/02; B65H 20/36

(52) U.S. Cl. ..... 242/564.4; 242/535.3

(58) Field of Search ..... 242/564.4, 564.3, 242/564.5, 564, 416, 417, 418, 420, 420.1, 420.2, 420.4, 535.3

(56) References Cited

U.S. PATENT DOCUMENTS 3,989,201 A * 11/1976 Cottrell ..... 242/420.2
5,640,899 A 6/1997 Bell et al. ..... 100/2
5,657,612 A 8/1997 Renz et al. ..... 53/399
5,718,167 A 2/1998 Renz et al. ..... 100/29
5,746,882 A 5/1998 Bell et al. ..... 156/580
6,039,286 A 3/2000 Abrams et al. ..... 242/564.4

* cited by examiner

*Primary Examiner*—John M. Jillions
(74) *Attorney, Agent, or Firm*—Donald J. Breh; Mark W. Croll; Lisa M. Soltis

(57) ABSTRACT

A strapping machine having an inertial rotating system allowing for strapping materials to be continually fed to the feed wheel of the device is provided. The inertial rotating system allows the strapping machine to continue to feed strapping material such that loops of excess material are not generated upon the cessation of pull force on the strapping material. The inertial rotating system includes a twisted belt allowing the motor shaft to be placed approximately perpendicular to the pulley attached to the reel of strapping material such that the pulley and strap may be housed within the housing of the strapping machine. The use of a twisted belt allows for the use of a motor having a single drive shaft, thus simplifying the motor used in the strapping machine. The inertial rotating system further provides a means to rewind and recover strapping material from the strapping machine.

9 Claims, 3 Drawing Sheets

FIG. 3

STRAPPING MACHINE WITH TWISTED BELT DRIVE

FIELD OF THE INVENTION

The present invention concerns a novel strapping machine, for positioning and securing a binding strap about an object or objects, having a single twisted-belt drive to allow inertia to continue to drive strapping material when power is cut off, to allow placement of moving parts within the strapping machine cabinet and to simplify the strapping machine.

BACKGROUND OF THE INVENTION

Proper operation of strapping machines requires that a particular strap tension be maintained in various locations within the strapping machine. In the initial loading of strapping material into the strapping machine, a reel of material is attached to the outside of the machine and strap is fed into a preliminary feeding mechanism. The strap is threaded through certain strap guides and is fed into a feed wheel mechanism associated with a drive motor. Tension in the strap is created by pulling the leading end of strapping material from the reel using the drive motor and a feed wheel.

As the strapping material is pulled by the feed wheel and drive motor, strap is unraveled from the reel of strapping material, causing the reel to rotate and build up inertial energy due to its rotation. While the strap is pulled at a constant rate, the strapping reel remains in control, unraveling strap at the required rate. However, when pulling ceases suddenly, for example when power is cut off to the drive motor, the inertial energy built up in the strapping reel causes the reel to continue to rotate and continue to unravel strapping material. When the drive motor ceases to operate, the feed wheel driven by the motor, also stops and strapping material cannot move to the next section of the strapping machine. As a result, strapping material accumulates behind the stopped feed wheel.

The rotation of the strapping material reel continues until the reel is stopped by a brake, or other external force, or friction overcomes inertia and the reel stops naturally. If the reel of strapping material is allowed to rotate until it is stopped by friction, the strapping material continues to unravel and loose strapping material accumulates inside the strapping machine. By the time the wheel is stopped, considerable amounts strapping material may be unreeled and may cause jamming of the strapping machine, loss of time in rewinding material and damage to the strapping machine.

Some prior art machines utilize braking means to stop the strap reel upon the cessation of power to the drive motor. However, the sudden stopping of reels of strapping material with a braking device may also cause problems in the strapping machine. Further, these prior art types of braking systems have been hampered by their mechanical complexity and have generally worked only to stop rotation in the forward direction of strap pull.

U.S. Pat. No. 6,039,286, for Inertial Strap Tensioning Apparatus and Method For Strapping Machine, solved many of the problems of prior art tensioning systems, by providing an inertial tensioning system utilizing the natural tendency of the heavy strap reel to stay in motion once it is put into motion. The inertial tensioning system of the '286 patent includes a belt and a pulley connected to the reel of strapping material and a second motor shaft, disposed at the rear of a gear motor in one embodiment, connected by a belt to the pulley. When the gear motor ceases operation, due, for example, to a cut off of energy, the reel, which continues to turn due to its inertial energy, causes the pulley and belt to turn thereby rotating the second shaft of the gear motor, which in turn, through the special gearing of the motor, causes the first shaft and, thereby, the feed wheel on the first drive shaft to continue to turn and expel strapping material. By utilizing the inertial energy of the larger strap reel to drive the feed wheel, the tension in the strap is maintained, as there is no sudden cut off of strap pulling force, and therefore, no loops are formed in the strap. Friction, and other natural forces, eventually cause the strap reel to come to a gentle stop; stopping the feed wheel gradually while maintaining the tension in the strap. However, the '286 patent requires, in one embodiment, the use of a gear motor with dual drive shaft and the inclusion of a pulley and belt to be associated with, and therefore, near the strap reel. In most strapping machines, the strap reel is generally placed outside of the machine housing, for ease of installation of new reels of strap. A belt and pulley system, provided to perform the above described inertia transfer function in the machine of the '286 patent, is also required and is taught to be adjacent the reel, on the outside of the protective housing of the machine. The belt and pulley system is thereby subjected to the ambient elements outside of the protective housing. Further, the placement of moving machinery on the exterior of the machine cabinet poses a potential hazard to the users of the machine.

It would be preferable to protect the mechanical moving parts of machines within the cabinet of the machine. Further, having moving parts inside of a machine housing increases the safety for workers who come in close contact with the strapping machine. It would also be preferable to have a strapping machine with a simplified motor that does not require dual drive shafts with the concomitant complexity in the gearing of such a motor.

SUMMARY OF THE INVENTION

In accordance with the present invention, a strapping machine is provided, having a motor with a drive shaft, driven by external power. A reel of strapping material is attached to the strapping machine to provide material for use in strapping an object or objects. An infeed wheel, engaged with the leading end of the strapping material, for pulling additional strapping material from the reel, is also provided on the strapping machine. The infeed wheel is mounted on the drive shaft of the motor, such that the rotation of the drive shaft by the motor causes strapping material to be pulled from the reel, causing the reel to rotate and naturally causing inertial energy to be stored in the reel. A dispenser pulley is attached to the reel of strapping material and a belt, interconnecting the drive shaft and the pulley, is provided. The pulley and belt are placed within the cabinet of the strapping machine. Upon cessation of external power to the motor, the continued rotation of the reel, due to its inertial energy, is translated to the pulley and belt causing the infeed wheel to continue to rotate and pull strapping material from the reel. In this manner strapping material does not accumulate behind the feed wheel.

In the preferred embodiment of the present invention, the drive shaft of the motor and the axis of rotation of the strapping reel are positioned approximately perpendicular to each other and the pulley is mounted concentrically with the reel. The pulley belt must therefore be twisted such that at one end of the belt loop the belt fits concentrically with the pulley and at the other end the belt loop is placed about the drive shaft of the motor. It is to be understood that the drive shaft of the motor and the axis of rotation of the strapping reel may be placed at any convenient angle to each other such that a single belt, twisted to any workable degree, may be utilized to drive the inertial braking system of the present invention, while maintaining the working elements of the inertial braking system within the cabinet of the strapping machine, without departing from the novel scope of the present invention. Further, implements such as pulley guides or wheels may be attached to the drive shaft of the motor, to assist in holding the belt onto the drive shaft, without departing from the novel scope of the present invention.

In the preferred embodiment of the present invention, the pulley and belt are housed within the frame of the strapping machine to provide protection from ambient conditions for the inertial braking system and to house moving parts for the protection of the user of the device. The motor of the present invention may be of the type having means to reverse the rotation of the drive shaft such that the reel of strapping material may be driven in one direction to remove strap and driven in the reverse direction to collect or rewind strap. It is to be understood that a motor which can be reversed by other means, such as reversing the power flow, may be used without departing from the novel scope of the present invention.

A more detailed explanation of the invention is provided in the following description and claims and is illustrated in the accompanying drawings.

DETAILED DESCRIPTION OF THE ILLUSTRATIVE EMBODIMENT

Figure 1:
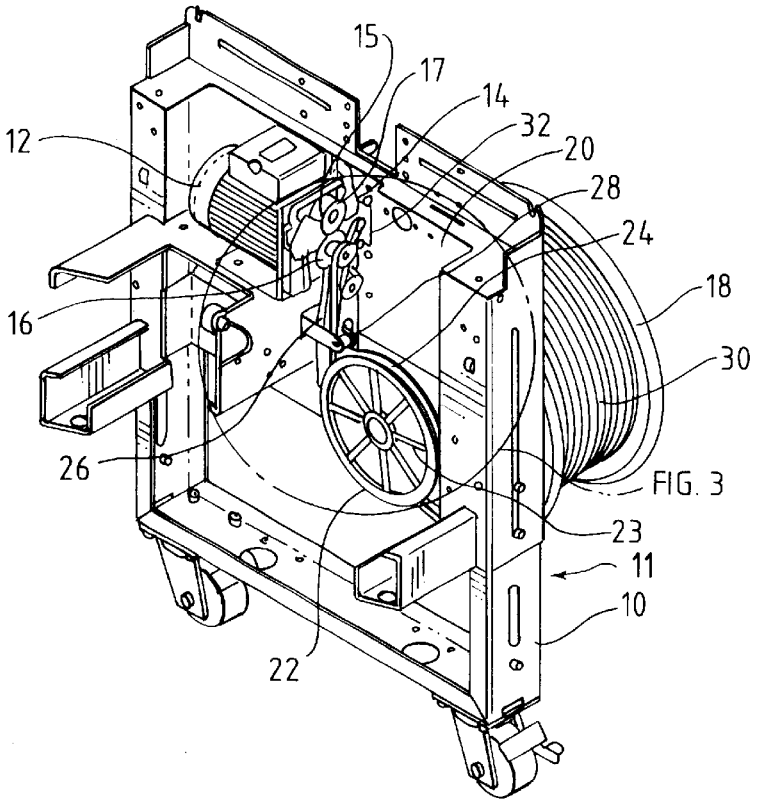
FIG. 1. is a perspective view of an interior section of a strapping machine having the inertial brake system of the present invention.
Figure 2:
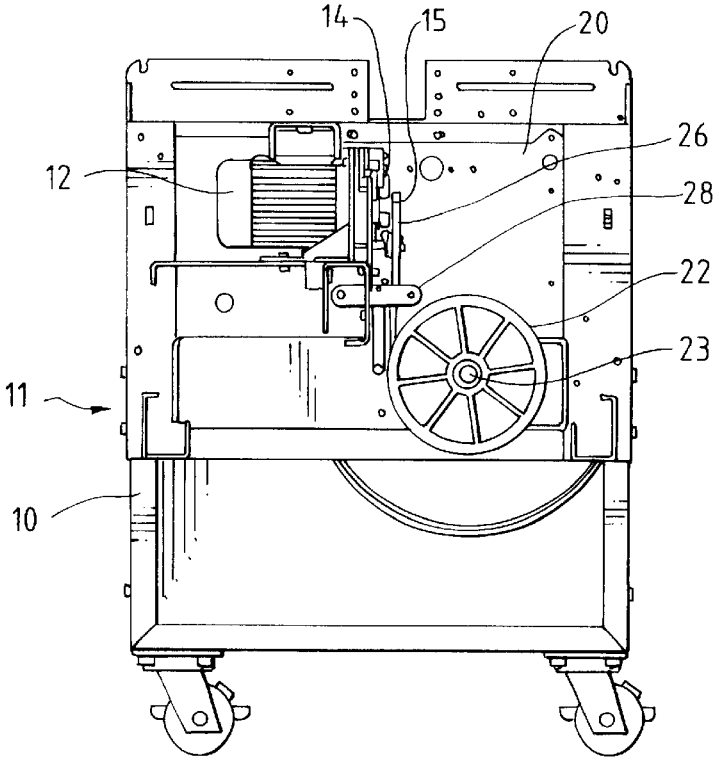
FIG. 2. is an elevational view of the interior section of the strapping machine of FIG. 1.
Figure 3:
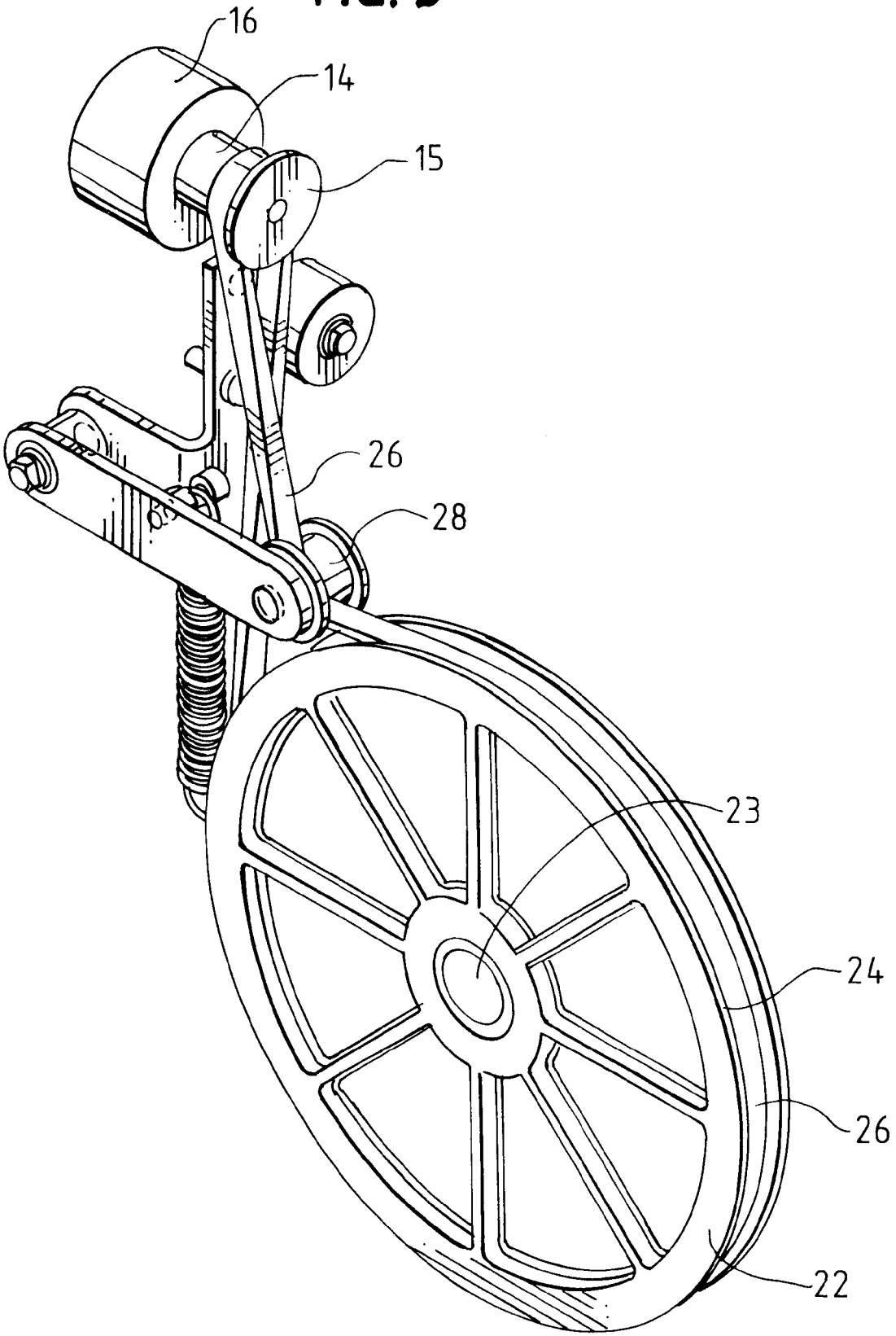
FIG. 3. is an isometric view of the motor shaft, pulley and belt system of the present invention.
Figure 4:
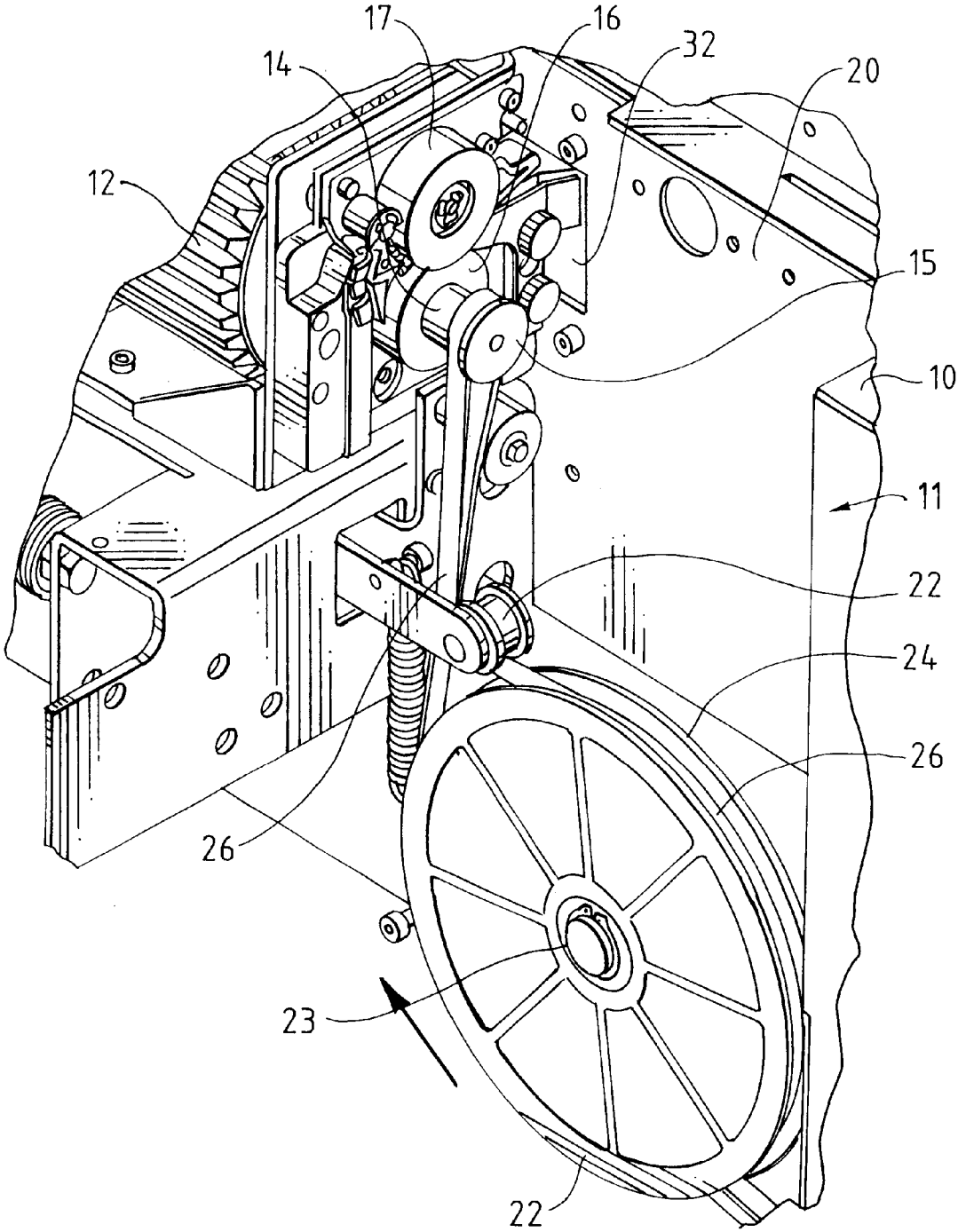
FIG. 4. is an enlarged perspective view, partially cut away, of the inertial braking system of FIG. 1.

Referring to the drawings, FIG. 1 shows a strapping machine 10, having a cabinet 11, and a motor 12 with a drive shaft 14. A feed wheel 16 and an end cap 15 are attached to drive shaft 14. A reel of strapping material 18 is attached to the outside of the cabinet 11 of strapping machine 10 onto a shaft (not shown) which traverses wall 20 of strapping machine 10. Reel 18 is attached to the shaft in such a manner that the shaft rotates with reel 18. A pulley 22, having a belt channel 24 about its outer diameter, is attached to the other end of the shaft (not shown) within cabinet 11. As shown in FIG. 1, pulley 22 is generally placed so that its axis of rotation is concentric with the axis of rotation of reel 18. A roller clutch 23 rotationally connects the shaft (not shown) to pulley 22. By this connection, pulley 22 may rotate with reel 18. Further, when it is desired to reverse the direction of rotation of reel 18, as when rewinding of strapping material is desired, the connection of pulley 22, the shaft and roller clutch 23 may be used in association with motor 12, when motor 12 is reversed in the manner described in greater detail below.

A belt 26, seated in channel 24 of pulley 22, guided by wheel 28, is twisted and then engaged with drive shaft 14 and is returned to channel 24. It is to be understood that a pulley wheel, having a belt channel, may be associated with shaft 14 such that belt 26 is more securely held on shaft 14. Belt 26 may be made of any of a number of different materials, including plastic, rubber, leather, metal or may be made in the form of a chain or other types of connecting means without departing from the novel scope of the present invention. Pulley 18 may be replaced with an appropriately sized gear wheel when belt 26 is replaced with a chain and an appropriate gear wheel is added to drive shaft 14. Further, drive belt 26 may be of any cross-section, such as flat, round, semi-circular, oval or other cross-section without departing from the novel scope of the present invention. Motor 12 may be of any type of motor, preferably one having a reverse speed, including electrical or gasoline, of any type of configuration, without departing from the novel scope of the present invention.

The present strapping machine enhancements provide a variety of improvements over known machines. For example, the present enhancements provide a means to gradually stop a reel of strapping material without the formation of loops of excess strap within the strapping machine. The present invention provides a strap reel braking system that utilizes the natural tendency of an object in motion to remain in motion. Further, the present invention provides a means of maintaining tension in the strap using a strap reel drive motor having a simple drive shaft system. The present invention simplifies a strapping machine by placing the working elements of an inertial braking system within the machine housing. The present invention makes a strapping machine safer for the user by placing the working elements of an inertial braking system within the machine housing.

In the operation of the strapping machine 10 of the present invention, the leading edge of a strip of strapping material 30 is fed from reel 18 through an opening 32 in wall 20 between feed wheel 16 and roller 17. Motor 12 is engaged, turning drive shaft 14 and feed wheel 16. The rotation of feed wheel 16, in association with roller 17, and the subsequent rotation of reel 18, causes strapping material 30 to be pulled from reel 18 through feed wheel 16 under constant tension. The rotation of reel 18 causes inertial energy to be developed and stored in reel 18, such that upon cessation of the work of motor 12 the inertia of reel 18 and pulley 22 will cause belt 26 to continue to drive shaft 14 and feed wheel 16. The inertia of reel 18 thus provides the motive force to continue the pulling of strapping material 30 from reel 18.

When it is desired to rewind strapping material 30 back onto reel 18, as for example when a new reel of strapping material is needed or when loops of material have formed further within strapping machine 10 (such as near the machine strapping gate or winder, not shown), motor 12 may be reversed, by reversing the energy input or by other means, causing drive shaft 14 to reverse the direction of rotation of belt 26 and pulley 22 and engage clutch 23 such that reel 18 is reversed and rotated so as to collect strapping material. Strapping material 30 is thus pulled from strapping machine 10 back onto reel 18. Strapping material is thereby preserved and is reusable within strapping machine 10.

Although an illustrative embodiment of the invention has been shown and described, it is to be understood that various modifications and substitutions may be made by those skilled in the art without departing from the novel spirit and scope of the invention.

What is claimed is:

1. A strapping machine strap reel inertia braking system comprising:

a strapping machine housing;

a motor, driven by external power, having a drive shaft;

a reel of strapping material;

a wheel, engaged with an end of said strapping material pulled from said reel, for pulling additional strapping material from said reel, said wheel being mounted on said drive shaft such that the rotation of said drive shaft by said motor causes strapping material to be pulled from said reel;

a pulley attached to said reel;

a belt, within said strapping machine housing, interconnecting said drive shaft and said pulley, such that upon cessation of motor power, inertial energy in said reel causes said reel to continue to rotate, said rotation being translated to said pulley and said belt, causing rotation of said wheel such that additional strapping material may continue to be pulled from said reel, wherein said drive shaft and pulley being disposed such that said belt is twisted.

2. The strapping machine of claim 1, including a strapping machine housing, wherein said drive shaft and pulley are contained within said strapping machine housing and said reel of strapping material is attachable to said strapping machine outside of said housing.

3. The strapping machine of claim 1, wherein said motor is reversible such that said motor, pulley and belt can, when said motor is reversed, cause said strapping material to be rewound onto said strap reel.

4. A strapping machine strap reel inertia braking system comprising:

a strapping machine housing;

a motor, driven by external power, having a drive shaft;

a reel of strapping material;

a wheel, engaged with an end of said strapping material pulled from said reel, for pulling additional strapping material from said reel, said wheel being mounted on said drive shaft such that the rotation of said drive shaft by said motor causes strapping material to be pulled from said reel;

a pulley attached to said reel; and a belt, within said strapping machine housing, interconnecting said drive shaft and said pulley such that upon cessation of motor power, inertial energy in said reel causes said reel to continue to rotate, said rotation being translated to said pulley and said belt, causing rotation of said wheel such that additional strapping material may continue to be pulled from said reel, wherein said drive shaft and pulley are disposed at an angle of about 90 degrees to each other and said belt is twisted such that it is operationally seated on said pulley and said drive shaft.

5. The strapping machine of claim 4, wherein said motor is reversible such that said motor, pulley and belt can, when said motor is reversed, cause said strapping material to be rewound onto said strap reel.

6. A strapping machine strap reel inertia braking system comprising:

a motor, driven by external power, having a drive shaft;

a reel of strapping material, having an axis of rotation generally perpendicular to said drive shaft;

an infeed wheel, engaged with an end of said strapping material pulled from said reel, for pulling additional strapping material from said reel, said infeed wheel being mounted on said drive shaft such that the rotation of said drive shaft by said motor causes strapping material to be pulled from said reel;

a dispenser pulley attached concentrically to said reel; and a belt, twisted such that it may be placed about said drive shaft and said dispenser pulley, such that upon cessation of motor power, inertial energy compels said reel to continue to rotate, said rotation being translated to said pulley and said belt, causing rotation of said infeed wheel such that additional strapping material may continue to be pulled from said reel.

7. The strapping machine of claim 6, including a strapping machine housing, said pulley and belt being housed within said strapping machine housing.

8. The strapping machine of claim 6, including a clutch and an axle, said axle rotationally connecting said pulley with said strap reel, said clutch allowing the rotation, in a first, strap-unwinding direction and, if desired, a second strap-rewinding direction, of said pulley and said reel.

9. A method of controlled braking of a strap reel, including the steps of:

providing a motor, driven by external power, said motor having a drive shaft;

providing a reel of strapping material, having an axis of rotation generally perpendicular to said drive shaft;

providing an infeed wheel, engaged with an end of said strapping material pulled from said reel, for pulling additional strapping material from said reel, said infeed wheel being mounted on said drive shaft such that the rotation of said drive shaft by said motor causes strapping material to be pulled from said reel;

providing a dispenser pulley attached concentrically to said reel; and providing a belt and twisting said belt such that it may be placed about said drive shaft and said dispenser pulley, so that upon cessation of motor power, inertial energy compels said reel to continue to rotate, said rotation being translated to said pulley and said belt, causing rotation of said infeed wheel such that additional strapping material may continue to be pulled from said reel until said inertial energy is naturally overcome by friction, braking said reel and said infeed wheel.

* * * * *